United States Patent [19]

Eheim, deceased et al.

[11] Patent Number: 4,870,936

[45] Date of Patent: Oct. 3, 1989

[54] FUEL INJECTION PUMP FOR INTERNAL COMBUSTION ENGINES

[75] Inventors: Franz Eheim, deceased, late of Stuttgart, by Helga Eheim, heiress; Max Straubel, Stuttgart, both of Fed. Rep. of Germany

[73] Assignee: Robert Bosch GmbH, Stuttgart, Fed. Rep. of Germany

[21] Appl. No.: 136,806

[22] Filed: Dec. 22, 1987

[30] Foreign Application Priority Data

Dec. 23, 1986 [DE] Fed. Rep. of Germany ..... 3644148

[51] Int. Cl.[4] ..... F02M 39/00

[52] U.S. Cl. ..... 123/449; 123/496; 123/503

[58] Field of Search ..... 123/496, 502, 501, 503, 123/500, 449, 373

[56] References Cited

U.S. PATENT DOCUMENTS

| | | | |
|---|---|---|---|
| 3,758,241 | 9/1973 | Eheim | 123/503 |
| 3,999,529 | 12/1976 | Davis | 123/500 |
| 4,211,520 | 7/1980 | Kranc | 123/500 |
| 4,220,128 | 9/1980 | Kobayashi | 123/449 |
| 4,409,939 | 10/1983 | Eheim | 123/449 |
| 4,413,600 | 11/1983 | Yanagawa | 123/449 |
| 4,649,883 | 3/1987 | Bohringer | 123/449 |
| 4,662,337 | 5/1987 | Eheim | 123/500 |
| 4,763,631 | 8/1988 | Fehlmann | 123/496 |

FOREIGN PATENT DOCUMENTS

| | | | |
|---|---|---|---|
| 3218275 | 10/1982 | Fed. Rep. of Germany . | |
| 3213724 | 12/1982 | Fed. Rep. of Germany . | |
| 0126828 | 10/1929 | Japan | 123/503 |
| 0170462 | 9/1984 | Japan | 123/449 |

*Primary Examiner*—Carl Stuart Miller

*Attorney, Agent, or Firm*—Edwin E. Greigg

[57] ABSTRACT

A fuel injection pump of the distributor type in which a pump piston is driven to reciprocate and rotate simultaneously, thereby acting as a distributer. For fuel injection quantity regulation, an annular slide that is displaceable on a pump piston is provided, by way of which the pump work chamber can be relieved. To attain a low injection rate in the idling range, in addition to a first outlet opening, controlled by an upper edge of the annular slide, second outlet openings axially offset from the first are provided, for a relief conduit of the pump work chamber which cooperate with a radial control opening, which communicates with the pump suction chamber and is disposed in the wall of the annular slide. In the opening direction of this control opening, a groove provided with a throttle is provided, by way of which during idling operation, prior to the opening of the first relief opening, fuel can flow out of the pump piston in order to decrease the pumping rate of the pump piston. For higher load ranges, the control opening is moved out of the operative range of the groove which is effected by rotating the annular slide or interrupting the communication of the control opening with the suction chamber.

23 Claims, 6 Drawing Sheets

FUEL INJECTION PUMP FOR INTERNAL COMBUSTION ENGINES

BACKGROUND OF THE INVENTION

The invention is based on a fuel injection pump for internal combustion engines. In a fuel injection pump known from German Offenlegungsschrift 32 13 724, the pump piston has as its relief conduit an axial blind bore originating at the pump work chamber, from which bore a transverse conduit branches off to two first outlet openings, and a radial conduit also branches off to a second outlet opening. This second outlet opening is offset with respect to the first outlet openings toward the pump drive side and cooperates with a radial bore, which is disposed in the annular slide and by way of which communication with the relief chamber can be established. In the known fuel injection pump the radial bore is disposed such that, at an annular slide position corresponding to the low-load operating range during the pump piston supply stroke, the second outlet opening is in communication with the radial bore, while in the full-load range, the second outlet opening is not positioned to communicate with the radial bore. The annular slide must be fixed in a constant rotational position during this process, by means of a final control element of the fuel injection quantity regulator, in order for the desired association of the radial bore with the second outlet opening to be maintained. This apparatus serves to allow only some of the supply strokes of the pump piston to be effective in the low-load range; accordingly, a plurality of radial bores are provided, distributed around the annular slide, so that only every other pump piston supply stroke, for instance, leads to a pressure buildup in the pump work chamber and hence to the injection of fuel. Correspondingly, only half of the cylinders of the internal combustion engine serve to drive the engine. This provision is meant to lower fuel consumption in the partial-load range.

A fuel injection pump is also known from German Offenlegungsschrift 32 18 275, in which instead of the radial bores in the annular slide provided in the above-described known fuel injection pump, diametrically extending grooves originating at the end face of the annular slide are provided, which together with the face end of the annular slide serving as a first control edge cooperate with only a single outlet opening of the relief conduit. Thus, the grooves have second control edges for controlling the communication between the pump work chamber and the relief chamber prior to the first control edge coming into play. The annular slide here is not only axially displaceable on the pump piston as a function of the adjustment of a fuel injection quantity regulator, but is also rotatable by a torque device. By means of rotation, during the supply stroke of the pump piston, the outlet opening can be made to come into communication with one of the diametrically extending grooves in alternation, upon every supply stroke, or every other supply stroke, of the pump piston, depending on the number of grooves provided. Thus either the number of injections can be reduced by half, for example, similarly to what is known from the prior art described initially above, or the high-pressure supply of the fuel injection pump can be suppressed entirely. Furthermore, by reducing the width of the grooves, it is possible merely to throttle the outflow or "leakage" of fuel during a particular supply stroke, in order to reduce the fuel injection rate in the lower rpm range. This has the effect, as a so-called quiet-idle device, that the engine can be operated during idling, for example, with reduced combustion noise. The throttling grooves are located, in terms of control effectiveness, upstream of the first control edge.

In this known fuel injection pump, problems arise, however, in terms of controlling the quantity of fuel flowing out via the throttle cross sections. In particular, it is problematic to increase the fuel quantity continuously from a transition from the idling range to the partial-load range, to prevent a load jump upon load take-up. In particular, the outflow of the fuel quantity is dependent, in the known apparatus, on the rpm; that is, it decreases with increasing rpm. Problems also arise if the fuel injection pump has an associated injection onset adjusting device, which typically means that the first outlet opening is adjusted relative to the drive shaft rotational position of the fuel injection pump. For operation at a reduced fuel injection rate by means of leaks via the throttle groove, it has the disadvantage of requiring as many throttle grooves as there are pumping strokes executed by the pump piston per revolution.

OBJECT AND SUMMARY OF THE INVENTION

The fuel injection pump according to the invention has the advantage over the prior art that with the aid of the throttle, a quiet-idle device can be realized that can be shut off continuously with increasing torque desired, or increasing load, so that the full pumping rate of the pump piston is available at full-load operation, and a load-controlled, smooth transition from idling to partial-load operation is attained. The control opening in combination with the throttle also offers the opportunity of assuring quiet idling regardless of an injection onset adjustment, at which the pump piston position in terms of height relative to the annular slide position is rotated.

In one feature of the invention, there is an advantage that only one longitudinal throttle groove need be provided per outlet opening, and the control effectiveness of the throttle groove is maintained over a wide injection onset adjustment range. The second outlet opening can also be embodied as a simple mouth of a bore, and differences in stroke distance can be compensated for by the length of the longitudinal groove. An advantage in this construction is to embody only part of the longitudinal groove as a throttle, so that the overlapping length of the longitudinal groove with the control opening does not affect the flow rate that is determined by the throttle. In another feature of the invention, there is an advantage that the relief process is maximally independent of the injection timing adjustment. In another feature of the invention, the number of control openings on the annular slide is advantageously reduced, optionally to the point that there is only one control opening on the annular slide. Once again, this has the further advantage that the relief of the pump work chamber is independent of the injection timing. Furthermore, an advantageous opportunity for intervention is obtained for the shutoff of the relief or of the quiet-idle device, as described below.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
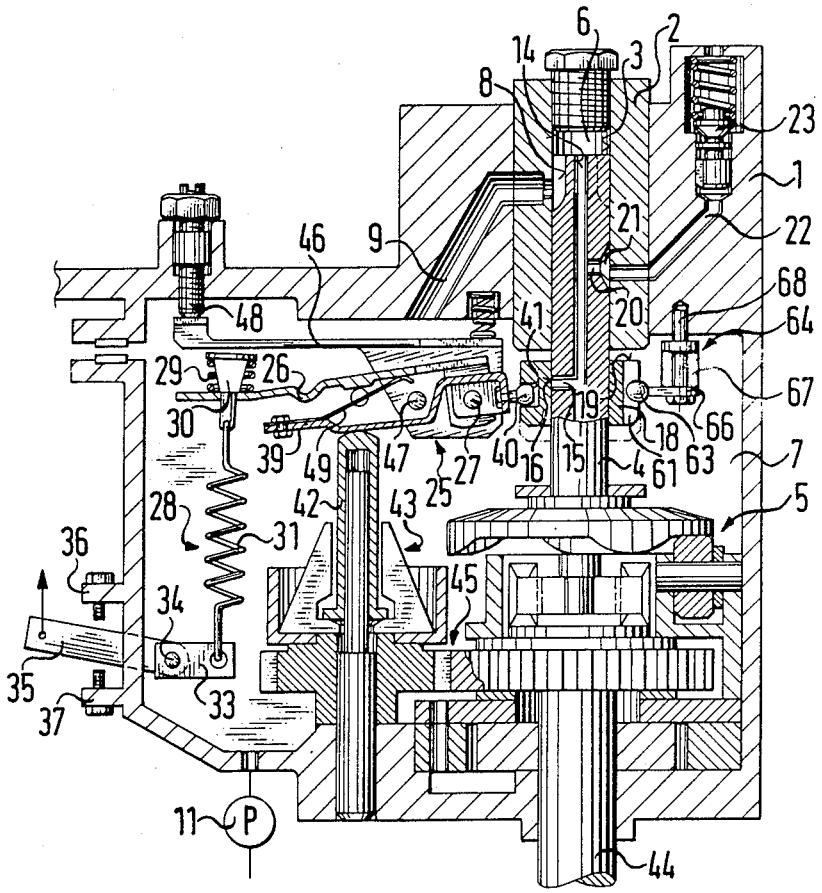
FIG. 1 is a longitudinal section through a fuel injection pump, shown in simplified form, on the structural principle of which the invention is realized.

A bushing 2 is disposed in a housing 1 of a fuel injection pump shown in FIG. 1. The inner bore 3 of bushing 2, forms a pump cylinder in which a pump piston 4 executes a simultaneously reciprocating and rotating motion, driven by a cam drive 5. On one face end, the pump piston encloses a pump work chamber 6 and the opposite end protrudes partway out of the inner bore 3 into a pump suction chamber 7 which is enclosed in the housing 1.

The pump work chamber 6 is supplied with fuel, via longitudinal grooves 8 disposed in the jacket face of the pump piston and via a suction bore 9 that originates at the pump suction chamber 7, which passes radially through the bushing 2 and extends within the housing 1, as long as the pump piston is executing its intake stroke or assumes its bottom dead center position. The pump suction chamber is supplied with fuel from a fuel tank, not shown here, via a feed pump 11. By means of a pressure control valve, not shown, the pressure is typically controlled in accordance with rpm in the suction chamber, so as to enable making an rpm-dependent injection adjustment, for example hydraulically, via a rpm pressure control. With increasing rpm, the stroke onset of the pump piston is adjusted to "early" in a known manner.

In the pump piston, a longitudinal conduit 14, which is embodied as a blind bore and serves as a relief conduit, leads away from the pump work chamber 6. Branching off from the longitudinal conduit is a transverse bore 15, which leads to a first outlet opening 16 on the circumference of the pump piston 4, into a region in which the pump piston protrudes into the suction chamber 7. Disposed on the pump piston in this region is a quantity adjusting device in the form of an annular slide 18, which with the jacket face of its inner ring slides tightly on the pump piston. This annular slide is rotatable and axially displaceable, and with a first control edge 19, embodied by the jacket face and an upper face end, the annular slide controls the first outlet opening 16.

Also branching off from the relief conduit 14, which preferably extends coaxially with the pump piston axis, is a radial bore 20, which leads to a distributor opening 21 on the circumference of the pump piston. In the operating region of this distributor opening, feed lines 22 branch off from the inner bore 3 in a radial plane, which are distributed on the circumference of the inner bore 3 in accordance with the number of cylinders of the associated engine that are to be supplied with fuel. The feed lines lead via one valve 23 each, which is embodied in a known manner as a check valve or pressure relief valve, to the fuel injection locations, not shown. As soon as the suction bore 9 is closed by the jacket face of the pump piston, at the onset of the supply stroke of the pump piston following a corresponding rotation of the pump piston, the fuel located in the pump work chamber 6 is pumped to these injection locations via the relief conduit 14, the radial bore 20 and the distributor groove 21. This pumping is interrupted whenever the first outlet openings 16, in the course of the pump piston stroke, are opened by the control edge 19 and come into communication with the suction chamber 7. From that point on, the remaining fuel positively displaced by the pump piston is pumped only into the suction chamber. The higher the level at which the annular slide 18 is adjusted toward the pump work chamber, the greater the quantity of fuel pumped by the pump piston.

The fuel injection quantity regulator 25 provided for the adjustment of the annular slide has a tensioning lver 26, which is pivotable about a shaft 27. The tensioning lever has one lever arm, and is coupled at its lever arm end to a governor spring assembly 28. This assembly comprises an idling spring 29 disposed between the head of a coupling element 30 and the tensioning lver; the coupling element 30 is passed through an opening in the tensioning lever, and at its other end, remote from the head, it is connected to a main governor spring 31. The main governor spring 31, in turn, is suspended at one end from a pivot arm 33, which is adjustable with an adjusting lever 35, via a shaft 34 passed through the pump housing. The adjusting lever is arbitrarily actuatable between an adjustable full-load stop 36 and an adjustable idling stop 37 by a person operating the vehicle. For instance, the adjusting lever 35 is connected to the gas pedal, which the driver of the motor vehicle equipped with the engine and fuel injection pump actuates in accordance with the torque he selects. Instead of the simple helical spring shown here as the main governor spring, it is naturally also possible to use other governor spring assemblies that are of the multi-stage and/or pre-stressed type.

A starting lever 39 is also pivotable about the shaft 27; it is two-armed, and with one arm, via a ball head 40, it is coupled to the annular slide by engaging a transverse groove 41 extending in a radial plane to the annular slide. The other arm of the starting lever has a leaf spring 49, which as the starting spring is braced against the tensioning lever 26, thereby spreading it open. Acting upon this particular lever arm of the starting lever 39 is the final control element 42 of an rpm transducer in the form of a flyweight control assembly 43 of a known type, which is driven synchronously with the drive shaft 44 of the fuel injection pump, via a gear train 45. With increasing rpm, the final control element 42, along with the starting lever 39 and the annular slide 18, is accordingly displaced counter to the force of the starting spring 49, until the starting spring comes to rest on the tensioning lever 26. In the course of this movement, the annular slide is adjusted away from a highest position, nearest the pump work chamber and corresponding to a starting quantity setting, toward the pump piston drive side, thus rescinding the increased starting quantity. Once the starting lever comes to rest on the tensioning lever, both levers become pivotable counter to the force of the idling spring 29, until the main governor spring 31 comes into action, adjacent the idling range. Depending how this main governor spring is embodied, as either a variable-shaped governor spring or a minimum-maximum-speed governor spring, the tensioning lever is moved onward upon reaching the set rpm, and the annular slide 18 is displaced in order to reduce the injection quantity. In other words, a greater or lesser quantity of fuel is injected at a given rpm, depending on the position of the adjusting lever 35.

For adjustment, the shaft 27 is supported on an adjusting lever 46, which is pivotable about a shaft 47 attached to the housing and is kept in contact with an adjustable stop 48 by a spring opposite its pivot end.

Figure 2:
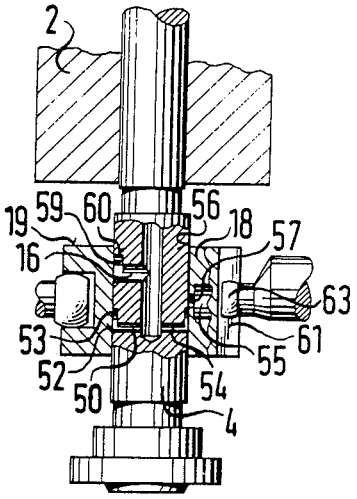
FIG. 2 is a fragmentary section through a distributor fuel injection pump of the type shown in FIG. 1, having a first exemplary embodiment of the invention.
Figure 3:
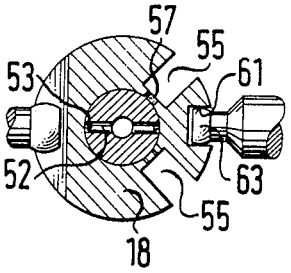
FIG. 3 is a section at right angles to the longitudinal section of FIG. 2.
Figure 6:
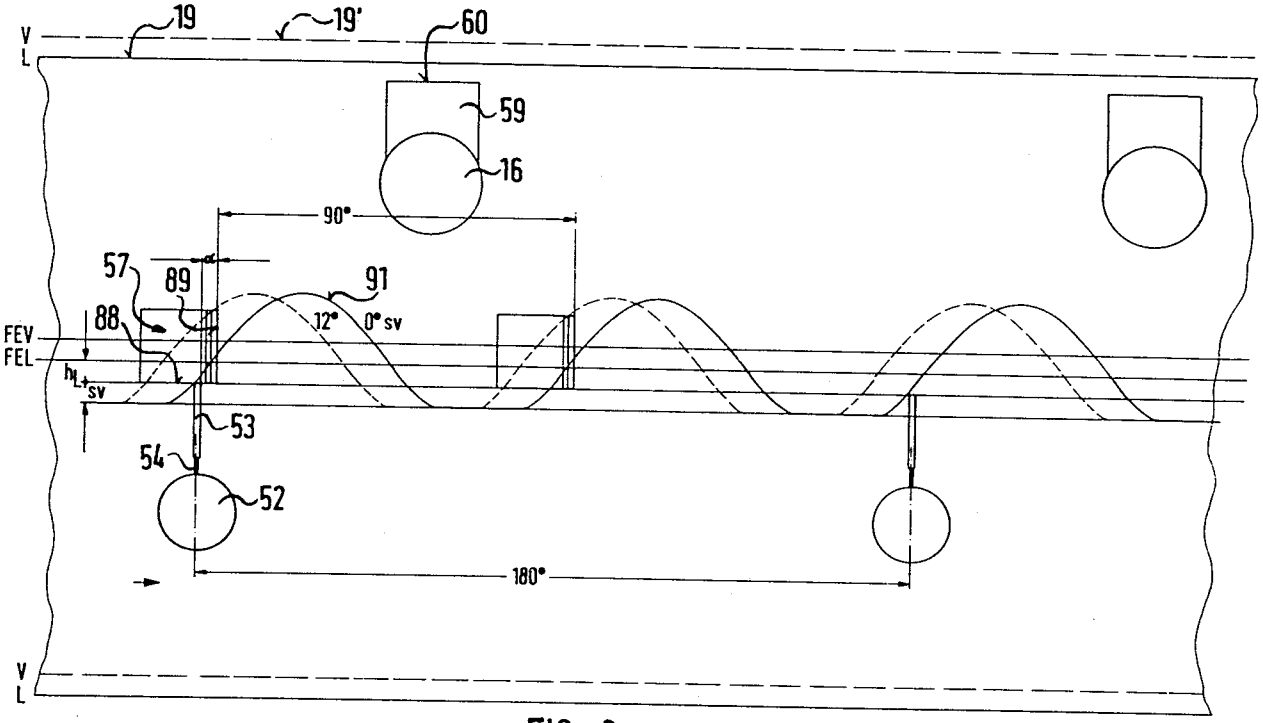
FIG. 6 is a developed view of the part of the pump piston jacket effective in control and of the annular slide for the exemplary embodiment of FIG. 2.

To the extent described thus far, the fuel injection pump is equivalent to a standard, known version. In FIG. 2, the further development in accordance with the invention is now shown for a first exemplary embodiment of the invention, which comprises the following: The relief conduit 14 in the pump piston is extended, in FIG. 2, beyond the outlet of the transverse bore 15 toward the pump piston drive end, where it has a second transverse conduit 50, the outlet openings of which, on the circumference of the pump piston, define second outlet openings 52. Originating in each of the second outlet openings is one longitudinal groove 53, machined into the jacket face of the pump piston; these grooves 53 extend toward the pump work chamber end, parallel to the piston axis, and are provided with a throttle 54. The throttle 54 is advantageously located at the junction between the longitudinal groove 53 and the second outlet opening 52. However, it is also possible for the entire longitudinal groove 53 to be embodied as a throttle groove. Also provided in the annular slide is a radial conduit 55, (FIG. 3) the inlet of which at the jacket face 56 of the inner ring is embodied as a control opening 57 of rectangular or square cross section, as shown in FIGS. 3 and 6. The first outlet opening 16, emerging via the transverse bore 15, advantageously also has a recess 59, which is not embodied in throttling fashion, and which extends toward the side of the pump work chamber and has a limiting edge 60 parallel to the first control edge 19.

In FIG. 2, the radial conduit 55 and the control opening 57 are shown rotated by 45° with respect to the plane of the drawing. From the section through the pump piston provided in FIG. 3, it is apparent that in the described example of an injection pump for supplying a four-cylinder internal combustion engine, two such radial conduits 55 must be provided in the annular slide, disposed in mirror symmetry with a plane that passes through the pump piston axis and through the center line of the ball head 40 engaging the annular slide 18. The outlet openings 52 having the longitudinal grooves 53 are located diametrically opposite one another. It is also apparent from the drawing that the annular slide, on its outside diametrically opposite the engagement point of the ball head 40, which engages a longitudinal groove extending parallel to the control edge 19, has a longitudinal groove 61 that extends in the longitudinal direction of the pump piston axis and furnishes guide faces for a sliding element, in the form of a ball head 63, engaging the longitudinal groove.

Figure 5:
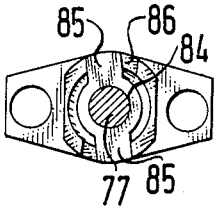
FIG. 5 is a plan view on the torque device shown in FIG. 4, with the adjusting lever removed.
Figure 4:
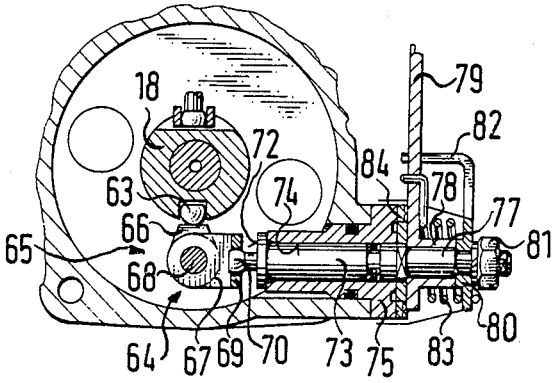
FIG. 4, in a section at right angles to the section shown in FIG. 2, which illustrates a torque device used in the exemplary embodiment of FIG. 2.

The ball head 63 is part of a torque device 64 by means of which the annular slide 18 can be rotated. The torque device has a bell crank 65, on one lever arm 66 of which the ball head 63 is provided. The bell crank is supported on a shaft 68 anchored to the housing, and the end of the other lever arm 67, which is bent into a U, is also disposed pivotably on this shaft 68. As FIG. 4 shows, the U-shaped lever arm 67 has a recess 69, which is engaged by an actuating arm 70. This arm 70 is mounted eccentrically on one face end 72 of a shaft 73, which is supported tightly in an inner bore 74 of a bushing 75 inserted into the pump housing and protrudes out of the fuel injection pump with its other end. There, the shaft has a diameter reduction 77, on which a hub 78 of a control lever 79 is rotatably supported. The control lever is fixed axially by means of a lever 80, which via a nut 80 is connected with the shaft 73 so as to be fixed against relative rotation therewith. A pre-stressed torque spring 83 is secured to the lever 80 and with its other end it engages the control lever 79, pressing it against the lever arm 82 of the lever 80 and thus coupling it to the shaft 73. Also connected to the shaft in a manner fixed against relative rotation, at the transition to the diameter reduction 77, is a disk 84, which has arms 85 that engage a recess 86 on the face end of the bushing 75. This is visible in the view provided in FIG. 5. The recess 86 is defined such that it serves as a stop for the arms 85 and limits the rotational angle of the shaft 73.

The control lever 79 is coupled to the adjusting lever 35 and can be moved synchronously with it. In so doing, under the influence of the torque spring 83, when the adjusting lever 35 is adjusted away from its idling stop 37 toward partial-load ranges, the control lever 79 rotates the shaft 73 until the shaft 73 is blocked by contact of the arms 85 on the stop 86. The control lever 79 is nevertheless capable of further movement, lifting away from the lever arm 82, thereupon tensing the torque spring 83. This allows free-wheeling motion, so that despite a large pivoting angle on the part of the adjusting lever 35 or the control lever 79, the shaft 73 is rotated only by a predetermined amount. With the rotation of the shaft 73, the annular slide is rotated as well and is put into a position in which the control openings 57 no longer cooperate with the longitudinal grooves 53.

In FIG. 6, a developed view of the pump piston jacket and the jacket face of the inner ring of the annular slide is shown. In this development, the positions of the control openings 57 are shown spaced apart by 90° and 270° of rotation. The association of the first outlet opening 16 and the second outlet openings 52 is also shown, together with a piston elevation curve for a zero injection setting and a piston elevation curve for a maximally early injection onset setting, for example at 12° of rotation. In the position shown, the longitudinal groove 53 is just coming into communication with the control opening 57, by overtaking its limiting edge 88 on the pump drive side, which forms a second control edge. Prior to this, the pump piston, beginning at its bottom dead center position, has executed a pre-stressing stroke sv, with which the pump work chamber is brought to a pressure equivalent to the opening pressure of the injection nozzles. During the ensuing stroke, fuel can now flow out via the second outlet opening, the throttle 54, the longitudinal groove 53, the control opening 57 and the radial conduit 55 to the relief chamber, that is, the pump suction chamber 7. As long as this outflow is possible, the injection pumping rate of the pump piston is reduced by the outflow quantity. With a quiet-idle device realized in this way, there is reduced combustion noise, which is especially desirable with the small injection quantities involved in the idling range. This reduced pumping rate prevails, however, only until such time as the longitudinal groove 53 is closed at point FEL, by the overtaking of the lateral limiting edge 89 of the control opening 57 that adjoins the control edge 88 and forms a third control edge; that is, it prevails over a leakage path from a stroke $h_L$ between the pre-stressing stroke sv and the point FEL. The pump piston pumping operation is terminated completely once the recess 59 and hence the first outlet opening 16 are opened toward the pump suction chamber upon the overtaking of the first control edge 19. For the case shown, along the pump piston elevation curve 91 for the zero injection timing angle, as soon as the end of the longitudinal groove 53 has reached the line FEL, the first outlet opening 16 is likewise opened, via the edge 19 positioned with L. This position is assumed by the annular slide during low-idling operation. For load takeup, the annular slide can now be adjusted upward, in the view shown, in the pump piston pumping direction. Then a shortened leakage path $h_L$ ensues, only after a stroke of the pump piston that begins at sv and at which pumping is done without leakage at the full injection pumping rate of the pump piston. Depending on the design, the shortened leakage path $h_L$ can be followed by a further residual injection pumping stroke at the full injection rate. The leakage path can thus be shortened continuously, until the line FEV for a full-load position of the annular slide. At this line, the limiting edge 60 as well has reached the line V or position 19' of the annular slide, which leads to the termination of fuel injection. It is apparent from the drawing that a load takeup is possible by displacement of the annular slide. The leakage duration can also be varied by means of the rotational position of the annular slide. For example, at an injection adjustment corresponding to the piston elevation curve 91', at 12° of adjustment toward "early", a very long leakage path is attained. Should that not be desired, then the possibility exists of shortening the leakage path via the third control edge 89, by rotating the annular slide counter to the direction of piston movement.

For a four-cylinder engine, the operation described can be realized with two control openings 57 at the circumference of the annular slide, if two outlet openings 52, offset by 180°, are simultaneously present. For a six-cylinder engine, three control openings 57 are correspondingly required, while for an uneven number of cylinder control openings must be distributed about the circumference in accordance with the pump piston pumping strokes, and these control openings will then be opened by only one second outlet opening. For the partial-load range and the full-load range, or for shutting off the quiet-idle device, the communication with the relief chamber 7 is broken by an actuating device, which in the exemplary embodiment is realized in the form of the torque device 64. By this device, the control openings 57 are put into a position in which the longitudinal grooves 53 can no longer come to coincide with the control openings. This is preferably accomplished by rotating the annular slide counter to the rotational direction of the pump piston. The length of the second control edge 88 in the rotational direction, which is adapted to the adjustment width of the injection adjustment, must be taken into account in this process.

Figure 7:
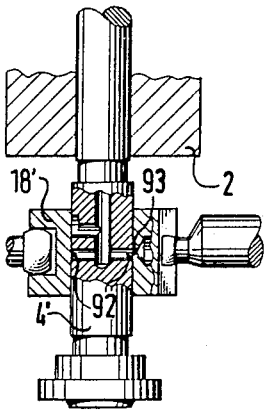
FIG. 7 shows a second exemplary embodiment of the invention in the form of a fragmentary longitudinal section through a distributor fuel injection pump of the type shown in FIG. 1.
Figure 8:
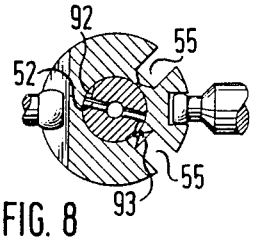
FIG. 8 is a section at right angles to the version of FIG. 7, in the plane of the control openings.
Figure 9:
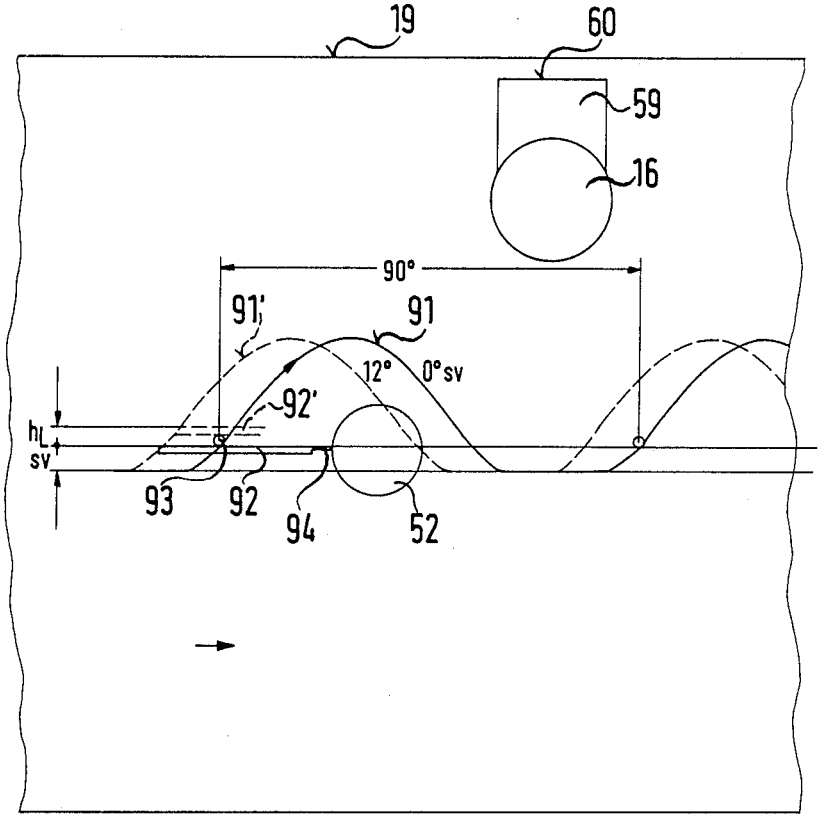
FIG. 9 is a developed view of the pump piston jacket portion effective in control for the version of FIG. 7, in a first exemplary embodiment.

FIG. 7 shows an exemplary embodiment that is modified by comparison with that of FIG. 2. Here, instead of the longitudinal grooves 53, partial circumferential grooves 92 or slits are machined into the pump piston jacket face, beginning at the second outlet openings 52. Furthermore, the control opening is in the form of a small bore 93. Otherwise, the arrangement is analogous to FIGS. 2 and 3 and is also as shown in FIG. 8. A developed view of the pump piston jacket face, with the slits 92 and the bores 93 of the jacket face 56 of the inner ring of the annular slide 18', is shown in FIG. 9. There, analogously to FIG. 6, pump piston elevation curves 91 for a 0° injection setting and 91' for a maximally early setting are shown. The partial circumferential grooves 92 lead away from the second outlet opening 52; a throttle 94 is formed, in grooves 92, for example by swaging, over a portion of their length, this throttle 94 being located directly at the entrance to the second outlet opening 52. In the position shown, the pump piston has again just executed its pre-stressing stroke sv, and the upper edge of the partial circumferential groove 92 is just coming into communication with the bore 93. This communication can be maintained over the width of the partial circumferential groove 92 and the diameter of the bore 93, which is represented by a correspondingly stroke, that is, the leakage path $h_L$, in FIG. 9. Beyond this position 92', shown in broken lines, of the partial circumferential groove, after initial leakage, the full pumping rate of the pump piston is re-established. Depending on the position of the annular slide, the leakage zone is located at an earlier or later point in the pump piston stroke. Because the partial circumferential groove 92 is long enough, and the throttle 94 is located at the transition to the outlet opening 52, the leakage is independent of the injection onset setting, which can readily be inferred from the location of the piston elevation curves 91 and 91'.

Figure 11:
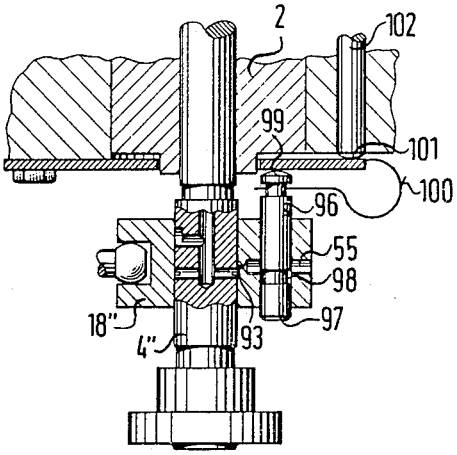
FIG. 11 shows a third exemplary embodiment of the invention in the form of a fragmentary longitudinal section through a distributor fuel injection pump as shown in FIG. 1.

In a third exemplary embodiment shown in FIG. 11, in a modification of that of FIG. 7, an annular slide 18'' is provided, in which instead of two bores serving as control openings in the annular slide 18', only one such bore 93 is provided. Correspondingly, the annular slide 18'' also has only one radial conduit 55. As shown by a section in a radial plane of the pump piston, FIG. 12, this radial conduit 55 is located opposite the engagement point of the ball head 63. The pump piston 4'' correspondingly has as many second outlet openings as it executes pumping strokes per revolution; in the present instance, in a four-cylinder version, it has four second outlet openings 52, from which the slits or partial circumferential grooves 92 already shown in FIG. 7 lead away, in a plane radial to the pump piston axis. The annular slide 18'' also has an axial through bore 96, which is penetrated by the radial bore 55 and extends parallel to the pump piston axis. Inserted into the bore 96 is a throttle device in the form of a slide bolt 97, which has an annular groove 98 with which a continuous communication of the radial conduit between the bore 93 and the pump suction chamber 7 can be established. Instead, the communication can be established not with an annular bore but with a transverse bore or transverse groove on the slide bolt 97. The slide bolt 97 has a head 99 on the end toward the bushing 2, and this head is gripped from behind by a leaf spring 100 that on its other end is coupled to an adjusting plate 101. This leaf spring keeps the head 99 of the slide bolt 97 in contact with the adjusting plate 101. The adjusting plate is firmly attached at one end to the pump housing and may for example be realized as a resilient element, and it protrudes laterally beyond the bushing 2 in such a way that an adjusting member 102 in the form of an adjusting bolt guided through the housing parallel to the bushing 2 can deflect the adjusting plate 101 and in so doing displace the slide bolt 97.

Figure 12:
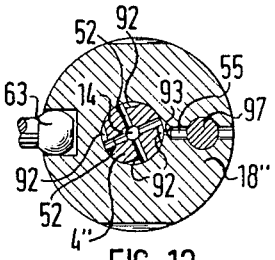
FIG. 12 is a section at right angles to the version of FIG. 11, in the plane of the control openings.

In terms of controlling the relief operation with the aid of the grooves 92 and the bore 93, this exemplary embodiment of FIGS. 11 and 12 functions the same as that described in conjunction with FIG. 7. The control principles illustrated in FIG. 9 are also applicable.

Figure 10:
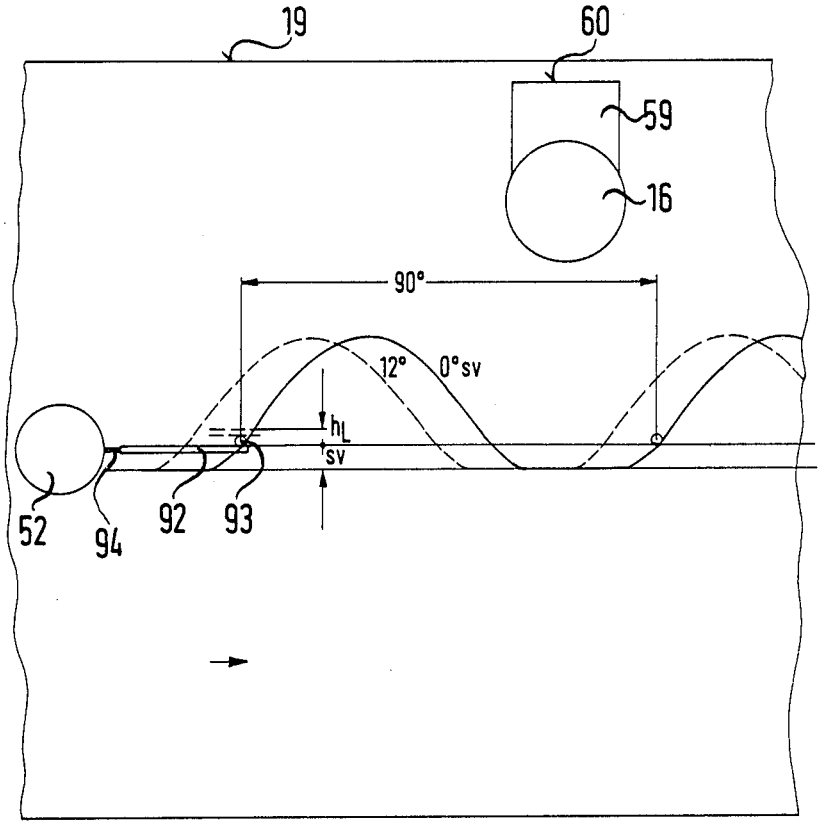
FIG. 10 shows a second embodiment analogously to FIG. 9.

The difference here is only the manner in which the relief is shut off. In the exemplary embodiment of FIG. 7, the shutoff is attained by rotating the annular slide, which is done in the same way as in the exemplary embodiment of FIG. 2. In this process, the partial circumferential grooves 92 move outside the operative range of the bores 93. In the exemplary embodiment of FIG. 11, contrarily, a load-dependent shutoff takes place, which is generated by the stroke movement of the annular slide 18''. If the annular slide 18'' is displaced toward the pump work chamber with increasing torque demand or increasing load, then the radial conduit 55 is closed via the slide bolt 97 which remains unmoved. Accordingly, beyond a predetermined stroke of the annular slide 18'', or beyond a predetermined load, no more fuel can flow out via the conduit 55 into the suction chamber. The point beyond which this shutoff takes place can advantageously be defined in a finely adjusted manner by deflection of the adjusting plate 101 via the adjusting member 102. In this exemplary embodiment, as in the second embodiment shown in FIG. 7, it is also possible to shift the throttling cross section either into the partial circumferential grooves 92, at their transition to the second outlet opening 52, or into the bore 93. The throttle can also be provided in the transverse conduit 50, or in the relief conduit 14 between the branching point of the transverse bore 15 and the transverse conduit 50. The partial circumferential grooves 92 can also adjoin the second outlet openings 52 on the left, as in FIG. 9. Alternatively, they can be disposed on the right, adjoining the second outlet opening 52, as shown in FIG. 10. Here the shutoff movement of the annular slide takes place in the direction of pump piston rotation.

Figure 13:
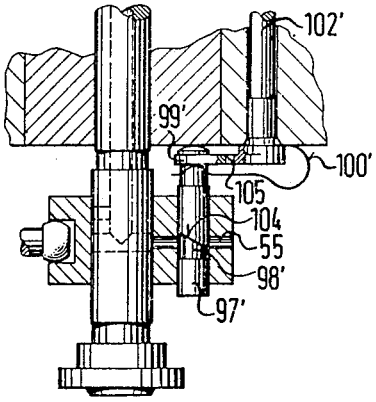
FIG. 13 shows a variant of the embodiment of FIG. 11, having a modified device for shutting off the control effectiveness of the control opening.

A variant of the exemplary embodiment of FIG. 11 is shown in FIG. 13, in which the slide bolt 97', instead of having an annular groove 98 with respective limiting edges located in a radial plane, has an annular groove 98', in which one of the limiting edges 104 has an oblique course. In this version, the point beyond which the radial conduit 55 is opened or closed can be adjusted by rotating the slide bolt 97'. This is done via radial serrations 105, provided on the circumference of the head 99' of the slide bolt, which mesh with radial serrations of the adjusting member 102'. In this embodiment, this adjusting member is axially fixed but is rotatable from outside the injection pump. Otherwise, the slide bolt 97' is retained in an end position in the same manner by means of the leaf spring 100' gripping the head 99' from behind. This time the leaf spring is secured directly to the pump housing with its other end. With this embodiment, by suitably rotating the adjusting member 102', a variable throttling of the radial conduit 55 can also be effected, which varies in accordance with load over the course of the stroke. In a special case, it is also possible by controlling the oblique limiting edge 104 to realize the bore 93 or the throttle 94, so that the radial conduit 55 can discharge without a diameter restriction into the inner bore 96 of the annular slide 18''' of FIG. 13. Via the adjusting member 102 or 102', not only an adjustment but also a control as a function of operating parameters can be performed, which affects the pumping rate for idling operation. In partial- or full-load operation, the quiet-idle device is shut off in any case.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines comprising a housing (1), a pump cylinder (3) in said housing, a pump piston (4) simultaneously reciprocating and rotating in said pump cylinder (3) and thus serving as a distributor for the pump fuel injection quantity to a plurality of injection locations, said pump piston defining a pump work chamber (6) in said pump cylinder (3), a relief conduit (14) in said piston extending from said pump work chamber axially to a radial bore (15) which includes a first outlet opening (16) on the pump piston circumference leading to a relief chamber (7), an annular slide (18) that is axially displaceable on the pump piston (4), said annular slide including a jacket face (56) and being rotatable, a fuel injection quantity regulator (25) which actuates said annular slide inside the relief chamber, said fuel injection quantity regulator being acted upon by an adjusting lever (35) for indicating a torque demand, said annular slide having a first control edge (19) which is oriented normal to the direction of the pump piston axis and a control opening (57) disposed on the jacket face (56) of the inner ring of said annular slide communicating with the relief chamber via a conduit (55) extending in the annular slide (18), in which said control opening is disposed below said first control edged (19) and spaced apart from the first control edge (19), and said control opening (57) cooperates with a second outlet opening (52) of the relief conduit (14) which is axially spaced relative to said first outlet opening (16), a throttle (54) provided between that portion of said relief conduit situated downstream of a connection point of said radial bore (15) to said relief conduit and said second outlet opening (52), and an actuating device (64, 97) for interrupting a possibility of communication between the second outlet opening (52) and the relief chamber (7), said interruption being effected as a function of load.

2. A fuel injection pump as defined by claim 1, in which said actuating device comprises a torque device (64) connected to said annular slide (18), by means of which torque device said annular slide is adjusted in the upper load range, into a rotational position in which during the entire pumping stroke of the pump piston (4) the second controlled outlet opening (52) does not come into communication with the control opening (57).

3. The fuel injection pump as defined by claim 1, in which said actuating device comprises a throttle device (97), which is disposed in said conduit (55) in the annular slide (18") and is actuated by means of a load-dependent adjustment of the annular slide and/or of an adjusting member (102).

4. A fuel injection pump as defined by claim 2, in which said throttle (54) connects with a longitudinal groove (53) that branches off from the second outlet opening (52).

5. A fuel injection pump as defined by claim 4, in which said control opening (57) has a rectangular or square cross section having two axially parallel limiting edges (89).

6. A fuel injection pump as defined by claim 2, which includes a transverse groove (92) extending in the circumferential direction of the pump piston and originating at the second outlet opening (52) cooperates with a control opening formed from a bore (93), wherein the throttle (94) is provided in the transverse groove or in the control opening.

7. The fuel injection pump as defined by claim 4, in which said relief conduit (14) has two diameterically opposed second outlet openings (52), which cooperate in alternation with control openings (57) distributed on the annular slide (18) in accordance with a rotational angle spacing of the pumping strokes of the pump piston, the number of control openings (57) amounting to one-half the number of pump piston pumping strokes per revolution.

8. The fuel injection pump as defined by claim 5, in which said relief conduit (14) has two diametrically opposed second outlet openings (52), which cooperate in alternation with control openings (57) distributed on the annular slide (18) in accordance with a rotational angle spacing of the pumping strokes of the pump piston, the number of control openings (57) amounting to one-half the number of pump piston pumping strokes per revolution.

9. The fuel injection pump as defined by claim 6, in which said relief conduit (14) has two diametrically opposed second outlet openings (52), which cooperate in alternation with control openings (57) distributed on the annular slide (18) in accodance with a rotational angle spacing of the pumping strokes of the pump piston, the number of control openings (57) amounting to one-half the number of pump piston pumping strokes per revolution.

10. A fuel injection pump as defined by claim 7, in which for supplying four injection locations per pump piston revolution, two control openings (57) are disposed at a rotational angle spacing of 90° on the annular slide (18).

11. A fuel injection pump as defined by claim 8, in which for supplying four injection locations per pump piston revolution, two control openings (57) are disposed at a rotational angle spacing of 90° on the annular slide (18).

12. A fuel injection pump as defined by claim 9, in which for supplying four injection locations per pump piston revolution, two control openings (57) are disposed at a rotational angle spacing of 90° on the annular slide (18).

13. A fuel injection pump as defined by claim 10, in which said quantity regulator includes an adjusting device (40), said control openings (57) are located symmetrically with respect to an axial guide track (61) engaged by said torque device (64) of said annular slide (18), and symmetrically with respect to an engagement of said adjusting device (40) of said fuel injection quantity regulator (25), wherein the adjusting device (40) engages a transverse groove (41) located in a radial plane to the pump piston axis.

14. A fuel injection pump as defined by claim 11, in which said quantity regulator includes an adjusting device (40), said control openings (57) are located symmetrically with respect to an axial guide track (61) engaged by said torque device (64) of said annular slide (18), and symmetrically with respect to an engagement of said adjusting device (40) of said fuel injection quantity regulator (25), wherein the adjusting device (40) engages a transverse groove (41) located in a radial plane to the pump piston axis.

15. A fuel injection pump as defined by claim 12, in which said quantity regulator includes an adjusting device (40), said control openings (57) are located symmetrically with respect to an axial guide track (61) engaged by said torque device (64) of said annular slide (18), and symmetrically with respect to an engagement of said adjusting device (40) of said fuel injection quantity regulator (25), wherein the adjusting device (40) engages a transverse groove (41) located in a radial plane to the pump piston axis.

16. A fuel injection pump as defined by claim 3, in which a transverse groove (92) extending in the circumferential direction of the pump piston originates at the second outlet opening (52) said groove (92) cooperates with a control opening embodied by a bore (93), and a throttle is provided in said transverse groove or in the control opening.

17. A fuel injection pump as defined by claim 16, in which said throttle is a slide bolt (97) guided in a bore (96) exteding through said annular slide and said conduit (55) is parallel to the axis of the pump piston, said slide bolt is provided with a transverse conduit (98) forming control edges, via which conduit a passageway is established and interrupted, and said slide bolt 97 is coupled with said adjusting member that is adjustable in the direction of the pump axis.

18. A fuel injection pump as defined by claim 17, in which said adjusting member is secured resiliently to the housing of the fuel injection pump, said adjusting element includes a coupling spring (100) which engages said slide bolt, by means of which spring said slide bolt is retained on said adjusting member.

19. A fuel injection pump as defined by claim 17, in which said adjusting member is an adjusting bolt guided in the housing of the fuel injection pump coaxially with the axis of the slide bolt (97), and said slide bolt is retained by means of a spring (100) fastened between the housing of the fuel injection pump and the adjusting member.

20. A fuel injection pump as defined by claim 19, in which said spring is a leaf spring (100) engaging a head (99) of the slide bolt (97).

21. A fuel injection pump as defined by claim 17, in which said adjusting member is a shaft (102') guided in the housing (1) of the fuel injection pump, which shaft is coupled via serrations (105) with the slide bolt (96').

22. A fuel injection pump as defined by claim 21, in which said slide bolt (96') is rotatable by means of a shaft, and includes an obliquely extending control edge (104) that on one side defines a recess (98') for control of the conduit 55.

23. A fuel injection pump as defined by claim 16, in which said second outlet openings (52) are provided in accordance with a number of pumping strokes effected per pump piston revolution, said second outlet openings cooperating with a single control opening.

* * * * *